United States Patent [19]

Meisberger

[11] 4,314,434

[45] Feb. 9, 1982

[54] UTILITY LINE SUPPORT STRUCTURE

[76] Inventor: Raymond F. Meisberger, c/o Bruce-Lake Co., Box 550, Coatesville, Pa. 19320

[21] Appl. No.: 813,677

[22] Filed: Jul. 7, 1977

[51] Int. Cl.[3] ..... E04C 3/30

[52] U.S. Cl. ..... 52/721; 52/695; 52/650; 174/45 R

[58] Field of Search ..... 52/650, 695, 721, 730, 52/637, 638, 693, 726; 174/45

[56] References Cited

U.S. PATENT DOCUMENTS

| | | | |
|---|---|---|---|
| 1,200,453 | 10/1916 | Bates | 52/726 |
| 2,036,047 | 3/1936 | Hill | 52/299 |
| 3397502 | 4/1968 | Simpson | 52/693 |
| 3,612,291 | 10/1971 | Skubic | 52/637 |

FOREIGN PATENT DOCUMENTS

| | | | |
|---|---|---|---|
| 509390 | 1/1955 | Canada | 52/721 |
| 1151365 | 7/1953 | Fed. Rep. of Germany | 174/45 |
| 520413 | 6/1921 | France | 52/650 |
| 1509484 | 1/1968 | France | 174/45 |
| 366134 | 2/1932 | United Kingdom | 52/721 |
| 852830 | 11/1960 | United Kingdom | 52/693 |

*Primary Examiner*—Price C. Faw, Jr.
*Assistant Examiner*—Henry E. Raduazo
*Attorney, Agent, or Firm*—Harding, Earley & Follmer

[57] ABSTRACT

A utility line support structure having a pair of legs extending upwardly with respect to the ground in an H frame, the legs being made of structural elements having a web, a pair of side walls extending at right angles from a break line between the web and each side wall, and a pair of inturned flanges extending at right angles from a break line between each flange and its associated side wall, the flanges being parallel to the web and having edges defining a slot therebetween so that the legs have a generally C-shaped cross-section.

11 Claims, 10 Drawing Figures

UTILITY LINE SUPPORT STRUCTURE

BACKGROUND OF THE INVENTION

To support utility lines, for example, 345 KV power lines, it is conventional to use single pole structures, Y structures, H frame structures, and/or lattice steel towers.

Conventional utility line support structures may be made of tubular metal sections, wood, angle iron, or concrete. The concrete may be solid or tubular, and may be reinforced, post-tensioned, or pre-stressed.

Many conventional Y structures and H frame structures are made of tubular pole sections. Tubular pole sections are expensive.

One reason that closed sections such as tubes are expensive is because welding adjacent tube sections together to make a long pole requires using circumference welds that are difficult to make and require careful inspection and a high degree of quality control.

However, a closed section is desirable in utility line supports because they have a great deal of strength and torsional stability.

On the other hand, an open section, such as a channel, is easier and less expensive to manufacture, and is easier to work with in the field when installing it to form utility line support structures. Also, channel sections are easy to butt weld together with easily inspected welds.

Tubular steel poles compete with wooden poles as support structures for utility lines. While tubular steel poles are comparatively more expensive than wooden poles, tubular steel poles cost less to erect than the wooden ones.

Lattice steel towers are also used to support utility lines. Lattice steel also is more expensive to erect due to the many pieces and also they require four foundations precisely placed with respect to each other. Moreover, lattice steel towers are very rigid and do not deflect under load. If something happens to a utility line to suddenly increase the load, such as a wire breaking or ice falling off of one span but not the other, the tower either supports the load or it fails. On the other hand, tubular support structures have the advantage of deflecting when subjected to an increased load, so they continue to support the power transmission lines without falling to the ground.

In a transmission line supported by rigid steel towers, when a sudden load causes one of the towers to collapse, a number of other towers may also fall down because they cannot withstand the sudden increased load caused by the fallen tower. However, if the same imbalance occurs in a flexible support structure, the other flexible support structures deflect and by deflecting reduce the imbalanced load thus reducing the possibility of their falling down.

In at least one instance, 60 miles of power line and its supporting lattice steel towers cascaded down, one after the other, because the rigid towers could not deflect and withstand the increased load.

The various rolled shapes available as structural elements for utility line support structures, such as rolled "I" beams and channels, have not been acceptable to the utility companies because they are not economical or efficient from a strength viewpoint. Accordingly, there is a need for a utility line support structure that is economical and has a high strength to weight ratio.

SUMMARY OF THE INVENTION

It is an object of this invention to provide a utility line support structure comprising an open structural element having a generally C-shape that provides the advantages of easier and less expensive fabrication and erection, with the superior column and torsional strength normally associated with a closed structural element.

It is another object of the invention to provide an H frame utility line support structure that has a high strength at a low weight with a minimum of critical welds.

Briefly stated, these objects are achieved by the provision of a utility line support structure having a pair of legs extending upwardly with respect to the ground, the legs being made of a structural element having a generally C-shaped cross-section provided by a web, a pair of side walls extending at right angles to the web, and a pair of inturned flanges extending at right angles to each side wall, the flanges being parallel to the web and having edges defining a slot therebetween.

DETAILED DESCRIPTION OF THE INVENTION

Figure 1:
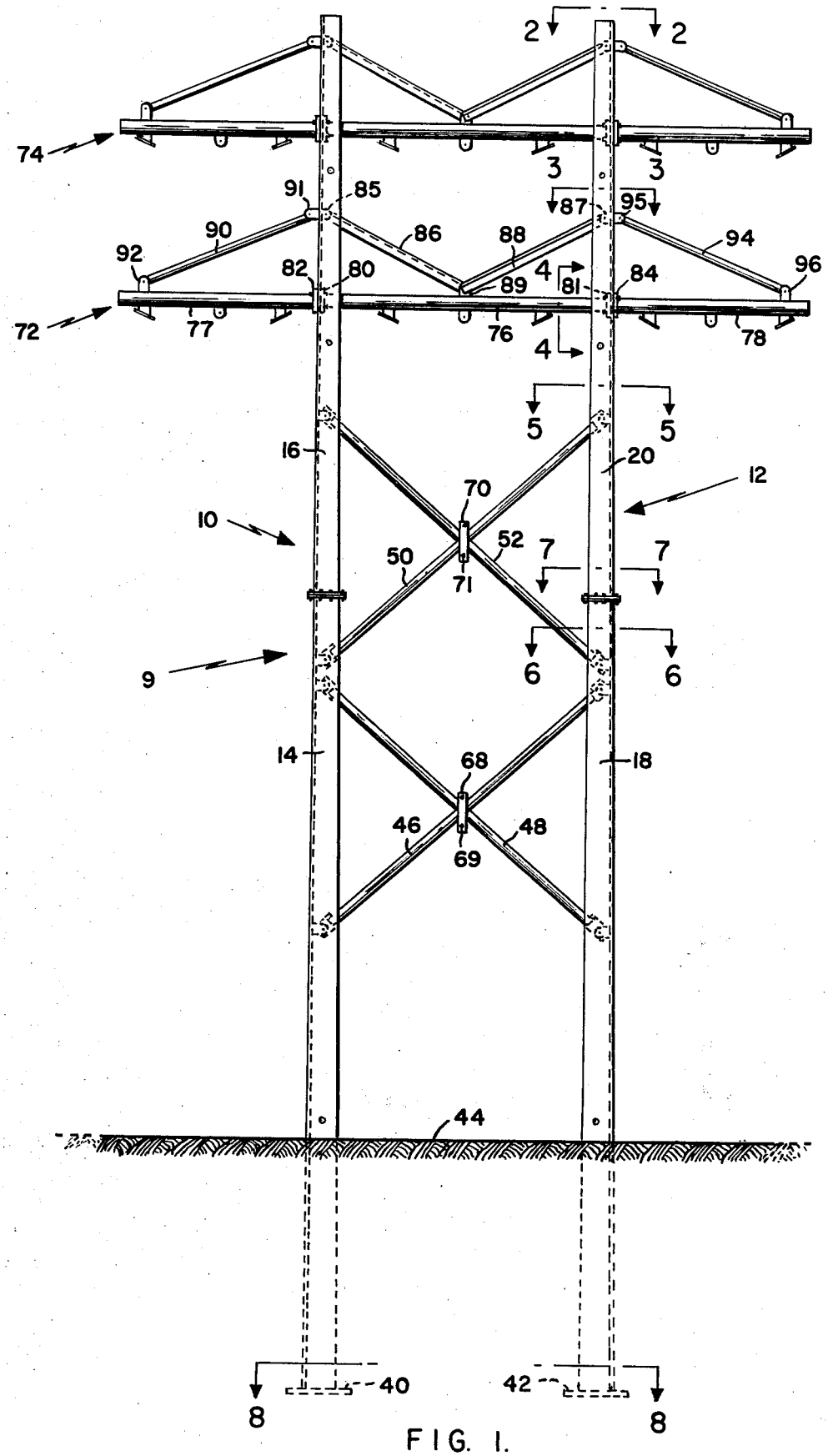
FIG. 1 is a view in front elevation of a utility line support structure in accordance with the invention.

In FIG. 1 there is shown a metal electric power line support structure in accordance with the invention constructed in the form of an H frame 9 as it is known in the art. H frame 9 comprises a pair of legs 10 and 12 extending upwardly from the ground, the legs 10 and 12 being made of the novel structural element in accordance with the invention. Leg 10 comprises a lower leg section 14 and an upper leg section 16 connected together in end-to-end relation, and leg 12 comprises a lower leg section 18 and an upper leg section 20 connected together in end-to-end relation.

Figure 2:
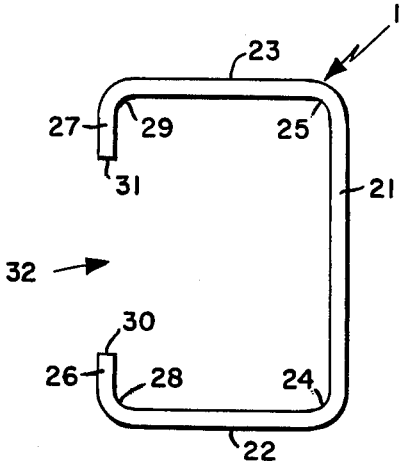
FIG. 2 is a view of a detail taken generally on line 2—2 of FIG. 1.

Each leg section 14, 16, 18 and 20 is made of a structural element in accordance with the invention and illustrated in FIG. 2 in cross-section, and comprises a tapered steel channel having a C-shaped cross-section, including a web 21, a pair of side walls 22 and 23, and a pair of inturned flanges 26 and 27. Side wall 22 extends at right angles from a break line 24 between side wall 22 and web 21 and side wall 23 extends at right angles from a break line 25 between web 21 and side wall 23. Inturned flange 26 extends at right angles from a break line 28 between flange 26 and side wall 22, and inturned flange 27 extends at right angles from a break line 29 between side wall 23 and inturned flange 27. The flanges 26 and 27 are parallel to the web 21 and have edges 30 and 31 defining an open slot 32 therebetween.

Leg sections 14, 16, 18 and 20 are arranged in the H frame shown in FIG. 1 with their open slots 32 facing each other. Each leg section 14, 16, 18 and 20 is made from a flat plate having a smaller top edge and a larger bottom edge that are parallel to each other. The longitudinal edges of the flat plate are symmetrical about the center line of the plate but may taper uniformly from a larger bottom edge to a smaller top edge. The C-shaped leg sections are formed by breaking the flat plate along the longitudinally extending break lines 24, 25, 28 and 29 to form the C-shape shown in FIG. 2. This breaking procedure also forms the slot 32 between the edges 30 and 31.

Legs 10 and 12 are made in the length desired by connecting together a plurality of leg sections in end-to-end relationship.

The form of the structural element in accordance with the invention permits the easy assembly of leg sections together to form a leg of the desired length. Since the connection between leg sections 14 and 16 is identical with the connection between leg sections 18 and 20, only the latter connection will be described in detail with particular reference to FIG. 7 wherein such connection is shown.

Figure 7:
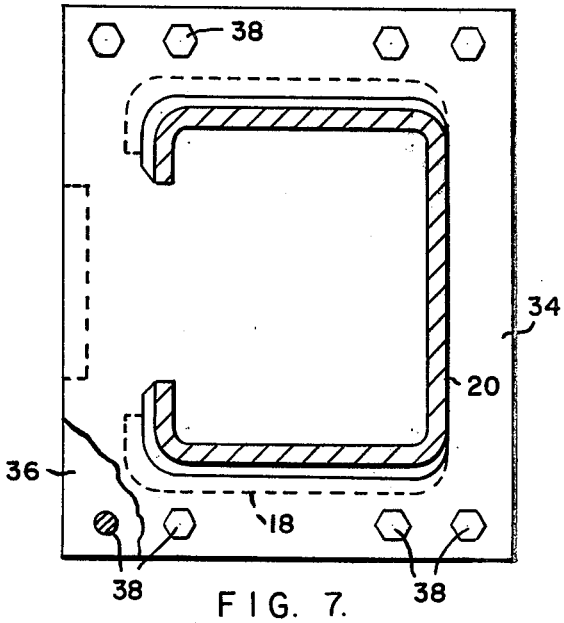
FIG. 7 is a detail view in section taken generally on line 7—7 of FIG. 1.

Referring particularly to FIG. 7, a rectangular flange 34 is welded to the bottom end of leg section 20 and a rectangular flange 36 is welded to the top end of leg section 18. Flanges 34 and 36 are the same size and are provided with eight aligned holes through which bolts 38 extend for cooperation with nuts to secure the flanges 36 and 38 and their associated leg sections 18 and 20 together. This form of connection can be made easily and is very strong. Alternatively, the legs 18 and 20 could be connected together by a splice plate.

Figure 8:
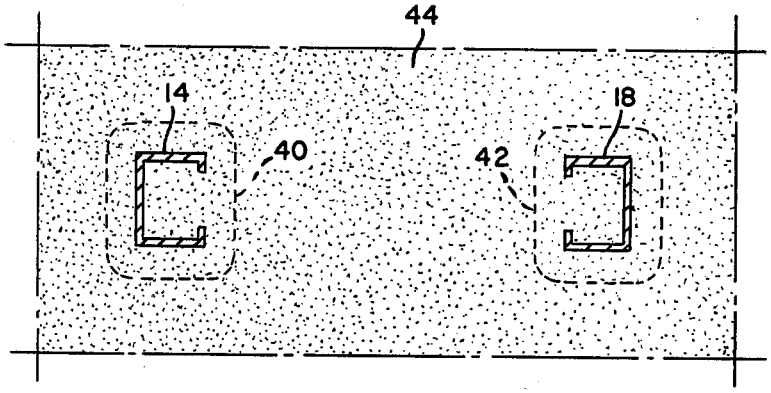
FIG. 8 is a view in section of the bottom portion of the H structure shown in FIG. 1 and taken generally on line 8—8 of FIG. 1.

Another feature of the metal utility line support structure of the invention is that the steel H frame 9 can be imbedded directly into the ground. To this end, lower leg section 14 has a transversely extending plate 40, FIG. 8, welded to its bottom end. Likewise, lower leg section 18 has a transverse plate 42 welded on its bottom end. The bottom portions of each of the leg sections 14 and 18, which have a C-shaped cross-section, and the associated plates 40 and 42, provide means for supporting the legs 10 and 12 in the ground so as to extend in parallel relation upwardly from the ground 44. These plates 40, 42 are bearing and/or uplift plates—one leg (under load) is always in tension and the other in compression (this reverses when the load reverses) thus the plates keep the uplift leg from pulling out and the compression leg from sinking in.

Figure 9:
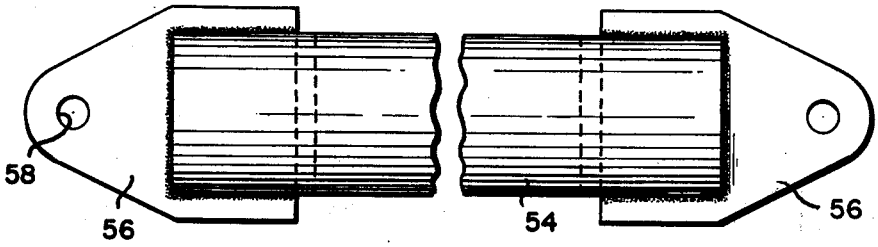
FIG. 9 is a detail view of a cross brace.
Figure 10:
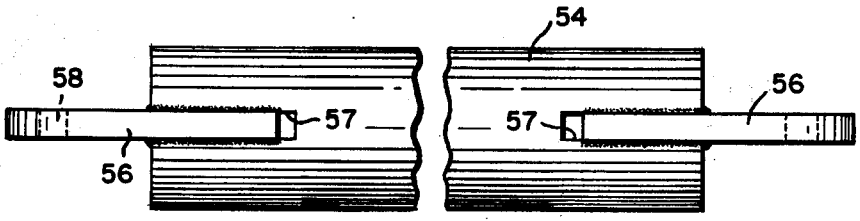
FIG. 10 is a top view of the cross brace shown in FIG. 9.

A pair of cross braces 46 and 48 extend between and are connected at their ends between two leg sections 14 and 18. Another pair of cross braces 50 and 52 extend between and are connected at their ends to legs 10 and 12 above cross braces 46 and 48. Cross braces 46, 48, 50 and 52 have the same construction as shown in detail in FIGS. 9 and 10 and comprise a tube 54 having vangs 56 welded onto their ends, each of the vangs 56 being received in a slot 57 formed in the tube 54, and having a hole 58. As shown in FIG. 1, each tubular cross brace 46, 48, 50 and 52 extends through the open slots 32 of the associated leg sections to be enclosed within the C-shape cross-section for cooperation with means for connecting the vangs 56 to the web 21 of an associated leg.

Figure 5:
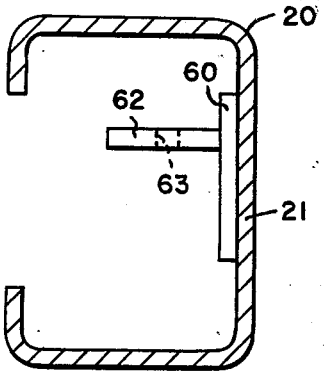
FIG. 5 is a view in section showing the vang connection for the cross braces and taken generally on line 5—5 of FIG. 1.
Figure 6:
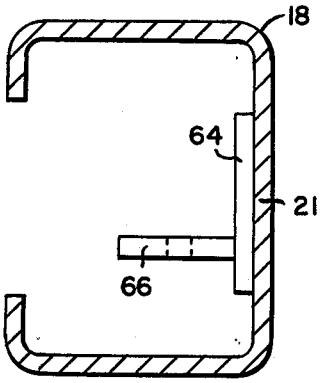
FIG. 6 is another view in section showing the vang connection for the cross braces and taken generally on line 6—6 of FIG. 1.

The vang connecting means is illustrated in FIGS. 5 and 6 and comprises, with respect to the connection shown in FIG. 5, a first plate 60 welded to web 21 of the associated leg section and extending flatly thereagainst, and a plate 62 welded onto plate 60 and extending perpendicularly therefrom and from the web 21 of leg section 20. Plate 62 is provided with a hole 63 of the same size as the hole 58 in vangs 56 so that holes 58 and 63 can be aligned for receipt of an appropriate connecting bolt which extends through the holes 58 and 63 for cooperation with a nut to secure a vang 54 to plate 62 of an appropriate leg section. Likewise in FIG. 6, a first plate 64 is welded flat to web 21 of leg section 18, and a second plate 66 is welded to plate 64 to extend perpendicularly therefrom and to the web 21 of the leg section 18. Plates 62 and 66 are offset with respect to the center line of the leg 12 to accommodate the vangs 56 of the cross braces which vangs 56 are offset by reason of the crossed arrangement of the cross braces.

It is noted that each pair of cross braces 46, 48, 50 and 52 are arranged to extend between the leg sections as described above in a crossed arrangement. Means are provided at the crossed portions of the cross braces 46 and 48, and the cross braces 50 and 52, to secure such cross braces together. For the cross braces 46 and 48 such means comprises a pair of plates 68 secured together by a pair of bolts 69, and for the cross braces 50 and 52 such means comprises a pair of plates 70 secured together by two bolts 71.

Figure 3:
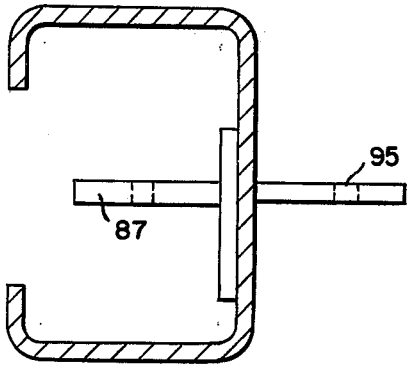
FIG. 3 is a view in section taken generally on line 3—3 of FIG. 1.
Figure 4:
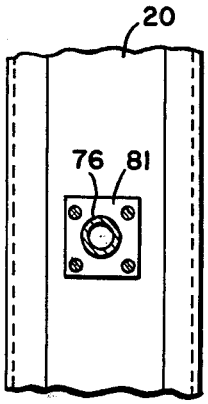
FIG. 4 is a view in section showing the detail of the cross arm connection to the legs and taken generally on line 4—4 of FIG. 1.

At the upper portion of leg sections 16 and 20 there is provided a pair of cross arms 72 and 74 for use in supporting electrical power transmission lines and other loads. Since cross arms 72 and 74 are identical in construction, only cross arm 74 will be described in detail and this will be done with particular reference to FIGS. 1, 3 and 4.

Cross arm 72 comprises a middle section 76 extending between leg sections 16 and 20, an end section 77 extending outwardly from a leg section 16, and an end section 78 extending outwardly from leg section 20. Middle section 76 comprises a tube having rectangular flanges 80 and 81 welded thereto at the tube ends. End section 77 comprises a tube having a rectangular flange 82 welded thereto at its inner end, and end section 78 comprises a tube having a rectangular flange 84 welded thereto at its inner end. Flange 80 of middle section 76 is secured to the web of cross-arm section 16, and flange 82 of end section 77 is secured to the web of leg section 16, by means of four bolts extending through cooperating holes in the flanges 80 and 82 and in the web of leg section 16 to cooperate with suitable nuts. Flange 81 of middle section 76 and flange 84 of end section 78 are also secured to the web of leg section 20 by means of four bolts which extend through cooperating holes in the flanges 81 and 84 and in the web of leg section 20 to cooperate with suitable nuts. In this manner, cross arm 72 is supported on leg sections 16 and 20 to extend horizontally as shown in FIG. 1. Each of the leg sections 76, 77 and 78 is provided with suitable transmission lines support members as is shown in FIG. 1.

Suitable bracing means is provided to provide further support for the sections 76, 77 and 78 of the cross arms 72. Such means comprises a pair of angle shaped braces 86 and 88. Brace 86 is connected at its ends between the web of leg section 16 and a bracket 89 welded onto the middle section 76 at the middle thereof. Brace 88 has its ends connected to and extends between the web of leg section 20 and bracket 89. A brace 90 is connected between a bracket 91 on the outside of the web of leg section 16 and a bracket 92 welded to the end section 77. A brace 94 has its ends connected to and extends between a bracket 95 welded onto the outside of the web of leg section 20 and a bracket 96 welded onto the end section 78. The arrangement of the brackets 87 and 95 is shown in detail in FIG. 3.

The direct embedment into the ground of H frame 9 is unique for a steel H frame. It is conventional to use an embedded plate and to bolt it to the legs of a conventional H frame.

H frame 9 can withstand some leg movement, unlike conventional lattice frames which must be anchored in concrete.

H frame 9 utilizes a press broken, steel open section that gives the desired strength and gives the added advantage of economy. Conventional open sections are rolled, not press broken, and are heavy and expensive.

I claim:

1. A metal electric power line support structure for supporting electric power transmission lines above the ground comprising:

a pair of legs extending upwardly with respect to the ground, the legs being adapted to be supported on the ground so that upper portions of the legs are in spaced apart relationship, and a cross-arm connected between and extending outwardly from the upper portions of said legs for supporting electric power transmission lines and the like, each of said legs comprising a structural element having a web, a pair of side walls extending at right angles to said web, and a pair of inturned flanges extending at right angles to each side wall, said inturned flanges being parallel to the web and having edges defining a slot therebetween so that said legs are generally C-shaped, each of said legs having a web and side walls that are tapered and include a plurality of sections connected in end-to-end relation.

2. The metal electric power line support structure of claim 1 wherein said pair of legs are arranged with the open slots thereof facing each other.

3. The metal electric power line support structure of claim 2 including a plurality of tubular cross braces connected at their ends onto said legs, each of said tubular cross braces having vangs formed at ends thereof and extending axially therefrom, the vangs of each of said cross braces extending through said open slots of said legs to be enclosed within said legs.

4. The metal electric power line support structure of claim 3 including means for connecting said vangs of said cross braces to the web of an associated leg.

5. The metal electric power line support structure of claim 1 wherein at least one cross brace extends between opposed sections of said legs in a crossed arrangement.

6. The metal electric power line support structure of claim 1 wherein said pair of side walls of said structural element extend at right angles to said web from a break line between said web and each side wall, and said pair of inturned flanges extend at right angles from a break line between each flange and its associated side wall.

7. The metal electric power line support structure of claim 6 including a plurality of tubular cross braces connected at their ends onto said legs, said pair of legs being arranged with the open slots facing each other, each of said tubular cross braces having vangs formed at ends thereof and extending axially therefrom, the vangs of each of said cross braces extending through said open slots of said legs to be enclosed within said legs, and including means for connecting said vangs to the web of an associated leg, said legs being tapered and including a plurality of sections connected in end-to-end relation, and including at least two cross braces extending between opposed sections of said leg in a crossed arrangement.

8. The metal electric power line support structure of claim 2 wherein said cross arm includes a section extending between and connected to the webs of the legs of said support structure and including means for connecting the ends of said cross arm section to the web of an associated leg.

9. A metal electric power line support structure for supporting electric power transmission lines above the ground comprising:

a pair of legs extending upwardly with respect to the ground, the legs being adapted to be supported on the ground so that upper portions of the legs are in spaced apart relationship, and a cross-arm connected between and extending outwardly from the upper portions of said legs for supporting electric power transmission lines and the like, each of said legs comprising a structural element having a web, a pair of side walls extending at right angles to said web, and a pair of inturned flanges extending at right angles to each side wall, said inturned flanges being parallel to the web and having edges defining a slot therebetween so that said legs are generally C-shaped, a pair of tubular cross braces extending between said legs, tongues extending from the ends of the cross braces and into the slots of the legs, and means connecting the cross-brace tongues to the legs, said tongue-connecting means including a first plate welded to the web of each leg and extending flatly thereagainst, a second plate welded to said first plate and extending perpendicularly therefrom and from the web of the leg, matching holes provided in said second plate and said cross-brace tongues, and bolt means extending through said matching holes for bolting said cross braces to the legs.

10. The metal electric power line support structure of claim 9, with said cross arm including a middle section extending between said legs and a first and second end sections extending outwardly from the legs, and cross-arm support means for supporting said cross arms comprising a middle bracket welded to the middle section at its middle, an end bracket welded to each end section at its outer end, an outer cross-arm brace connected between each end bracket and a leg, an inner cross-arm brace connected between each leg and the cross-arm middle bracket, and bolt means connecting the ends of the cross-arm braces to the cross-arm middle bracket, and bolt means connecting the ends of the cross-arm braces to the cross-arm brackets.

11. The metal electric power line support structure of claim 10, said cross arm including a middle section extending between the leg sections and comprising a tube with a flange welded onto each end, a first end section extending outwardly from one leg and having a flange welded onto its inner end, a second end section extending outwardly from the other leg and having a flange welded onto its inner end, bolt means connecting the flanges of the cross-arm sections to the legs, and transmission lines support members mounted on the cross-arm.

* * * * *